US007182503B1

(12) United States Patent
Lin

(10) Patent No.: US 7,182,503 B1
(45) Date of Patent: Feb. 27, 2007

(54) ALIGNMENT OF SOCKETS ENABLING TO ENGAGE WITH A LARGE NUMBER OF CHRISTMAS LAMPS

(76) Inventor: Mei-Lu Lin, P.O. Box 697, Fongyuan City, Taichung County (TW) 420

( * ) Notice: Subject to any disclaimer, the term of this patent is extended or adjusted under 35 U.S.C. 154(b) by 37 days.

(21) Appl. No.: 11/078,322

(22) Filed: Mar. 14, 2005

(51) Int. Cl.
*H01R 33/00* (2006.01)

(52) U.S. Cl. ..... 362/654; 362/249; 362/806

(58) Field of Classification Search ..... 362/249, 362/806, 654
See application file for complete search history.

(56) References Cited

U.S. PATENT DOCUMENTS 4,999,755 A * 3/1991 Lin ..... 362/250
6,033,088 A * 3/2000 Contigiani ..... 362/249
2006/0092637 A1* 5/2006 Yeh ..... 362/249

* cited by examiner

*Primary Examiner*—Renee Luebke
*Assistant Examiner*—Zahra I. Bennett

(57) ABSTRACT

An alignment of sockets enabling to engage with a large number of Christmas lamps includes a hollow rectangular seat having a plurality of circular openings for engaging within a plurality of lamps, and opened bottom, a pair of first semi-circular grooves in the bottom and an elongate slender slot in a lateral wall for disposing an elongate copper plate, a plurality of inverse U-shaped copper plate spacedly engaged between each pair of adjacent lamps, a pair of electric wires engaged with first semi-circular grooves a pierced by the tips of the elongate copper plate and one of the inverse U-shaped plates, an elongate cover covered the opened bottom of the seat having a pair of second semi-circular grooves and plurality of rectangular for stopping against the inverse U-shaped copper plates respectively.

4 Claims, 9 Drawing Sheets

ALIGNMENT OF SOCKETS ENABLING TO ENGAGE WITH A LARGE NUMBER OF CHRISTMAS LAMPS

BACKGROUND OF THE INVENTION

The present invention relates to Christmas lights and more particularly to an alignment of sockets enabling to engage with a large number of Christmas lamps which intensify the safety and pretty of Christmas lights and is capable of structural variety.

Nowadays, the Christmas lights is basically using a pair of electric wires to make a string of Christmas lights which is usually suspending from a Christmas tree and/or attaches to a wall to present festival climax. If one wants to make different shapes, he has to buy different shapes of frames to facilitate the surrounding of the strings of Christmas lights. This is uneconomic and irregular. Later, the producers try to improve the monotonous condition and produce a structure of combined double sockets to engage with the lamps which may be toward the same direction and/or toward opposite directions in order to increase more interesting and facilitates the shape making. But it still has to band with additional wires or cords. That is still requiring a lot of labor to accomplish.

SUMMARY OF THE PRESENT INVENTION

The present invention has a main object to provide an alignment of sockets enabling to engage with a large number of Christmas lamps which has a hollow interior rectangular seat integrated with a plurality of circular socket on the top for engagement of a large number of Christmas lamps and can be in variform without requiring any supporting means but safe and pretty and capable of suspending from any object.

Accordingly, the alignment of sockets enabling to engage with a large number of Christmas lamps of the present invention comprises generally a hollow interior rectangular seat having a plurality of protruding circular openings on the top for respectively engaging with a large number of lamps, an open bottom and a pair of first semi-circular grooves adjacent one end for disposing a pair of electric wires therein, a plurality of inverse U-shaped copper plates spacedly engaged within the seat of the lamps each of which has a pair of lead-in wires engaged respectively with the lateral portions of the inverse U-shaped copper plates, wherein the foremost inverse U-shaped copper plate has a tip on one of the lateral side pierced into the inner electric wire, an elongate copper plate including a first and a second transverse ends and a tip on the lower portion of the first transverse portion pierced into the outer electric wire, a rectangular cover engaged with the open bottom of the seat in a snap fitting and having a plurality of rectangular projections spacedly projected upward from the top respectively engaged with the inverse U-shaped copper plate, a pair of second semi-circular groove in one end engaged with the first semi-circular groove for securing the pair of electric wires, a U-shaped projection between the second semi-circular grooves for separating the elongate copper plate. So that an electric circulation is therefore established within the sockets.

The present invention will become more fully understood by reference to the following detailed description thereof when read in conjunction with the attached drawings.

DETAILED DESCRIPTION OF THE PREFERRED EMBODIMENT

Figure 1:
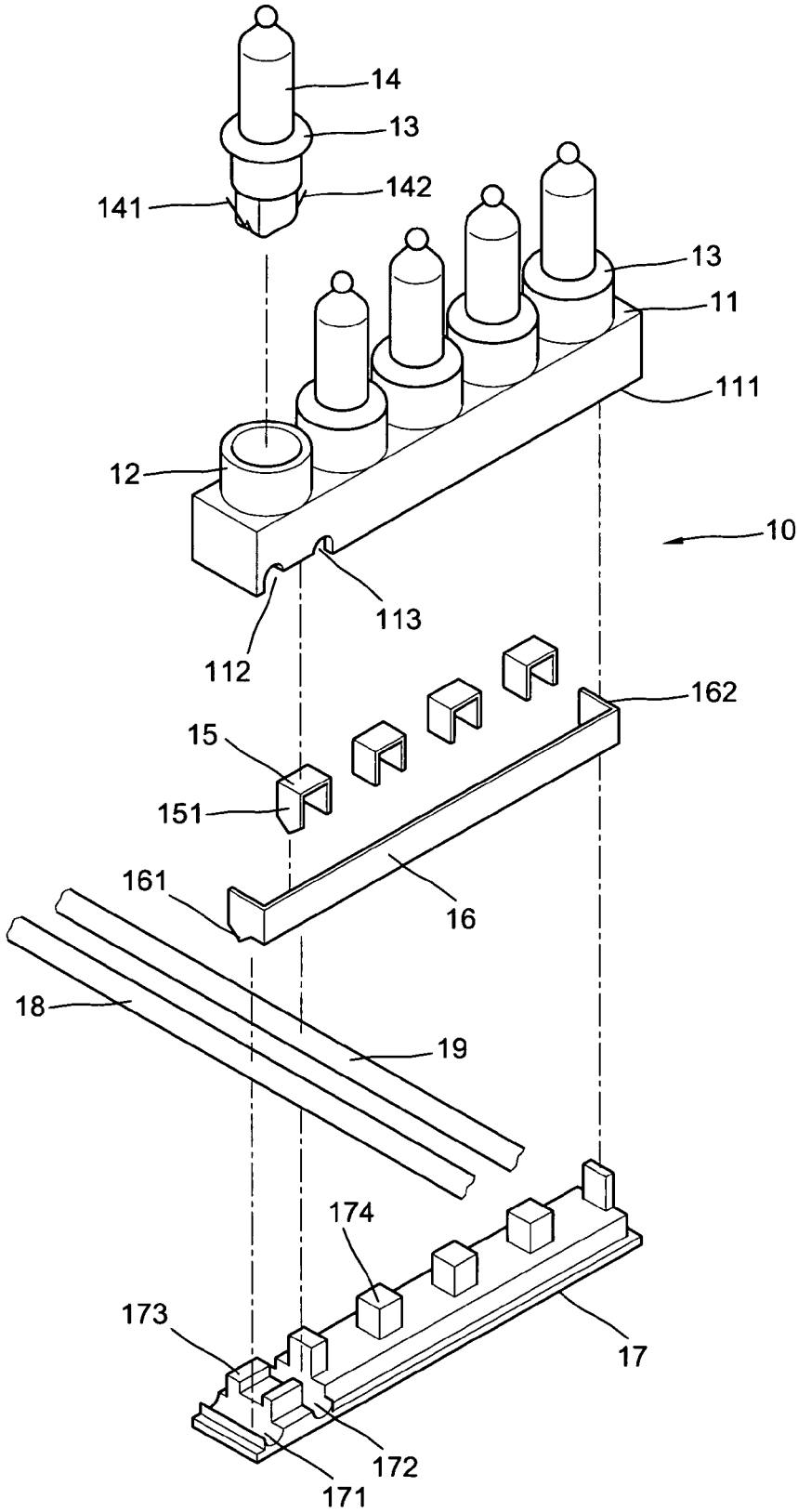
FIG. 1 is an exploded perspective view to show the preferred embodiment of the alignment of sockets of the present invention.
Figure 2:
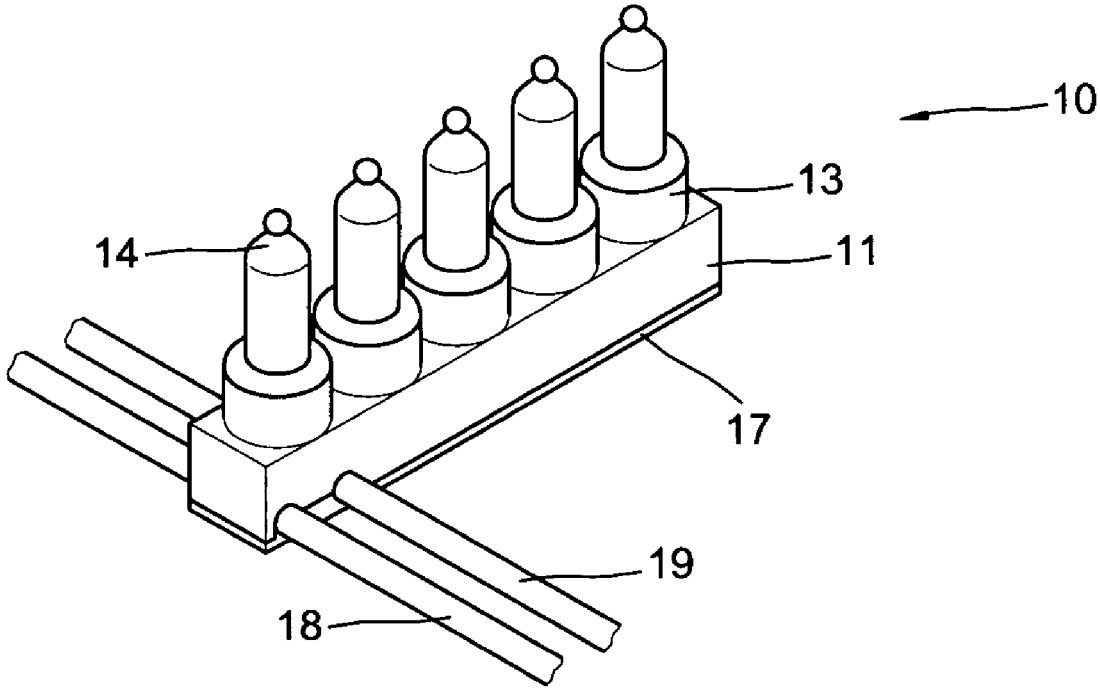
FIG. 2 is a perspective view to show the assembly of FIG. 1.
Figure 3:
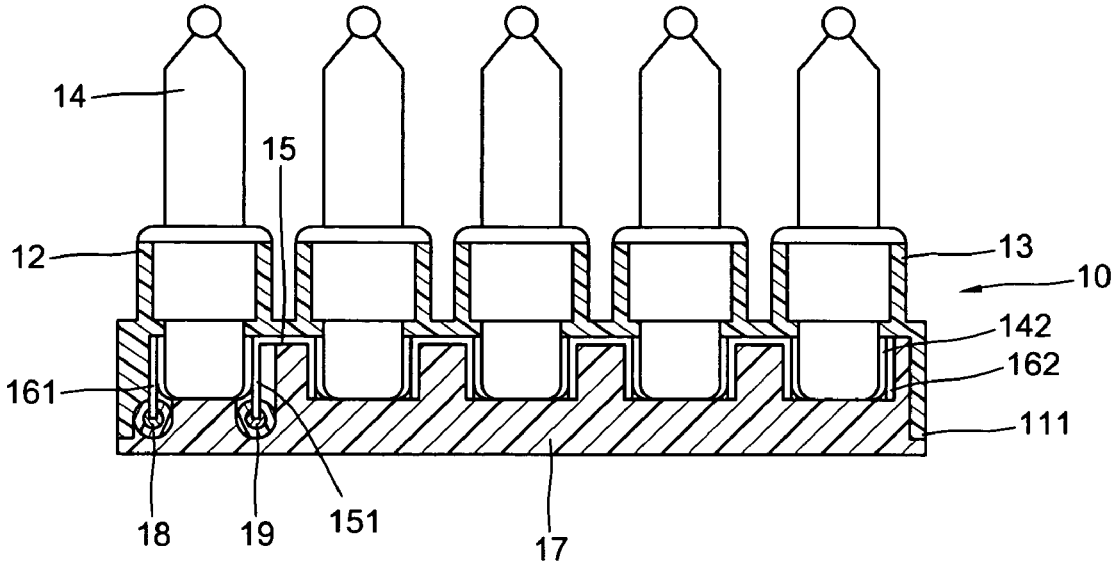
FIG. 3 is a vertical sectional view of FIG. 2.
Figure 4:
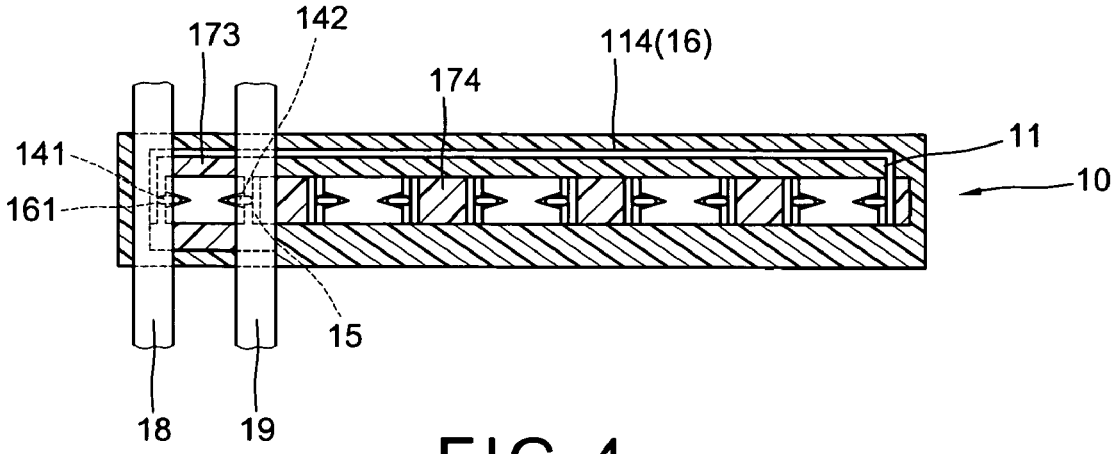
FIG. 4 is a top sectional view of FIG. 2.
Figure 5:
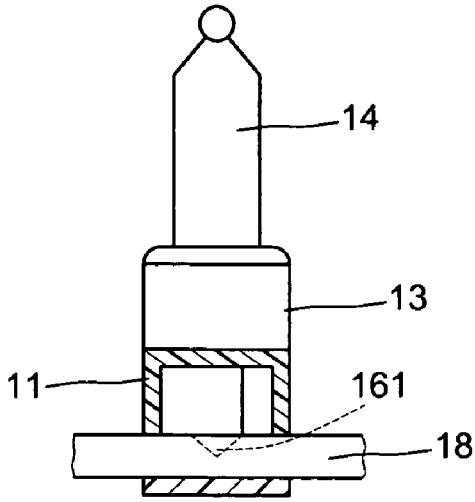
FIG. 5 is a cross sectional view to show the tip of an elongate copper plate pierced into an outer electric wire.
Figure 6:
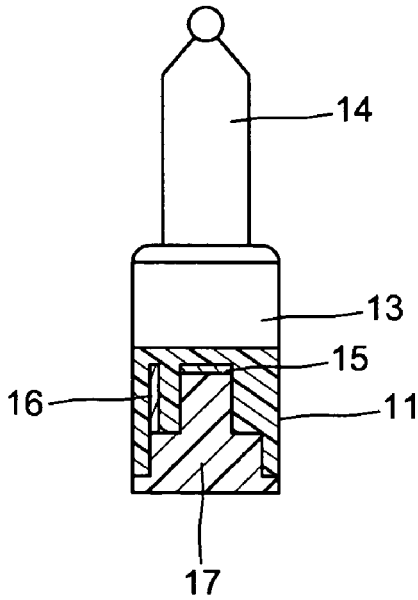
FIG. 6 is a cross sectional view of a U-shaped copper plate fixed by a rectangular projection of the cover.

With reference to the drawings and initiated from FIGS. 1 to 6, the alignment of sockets enabling to engage with a large number of Christmas lamps 10 of the present invention comprises a hollow interior rectangular seat 11 integrated with a plurality of protruding circular openings 12 which are spacedly formed on the top along the length thereof and communicating to the hollow interior for respectively engaging within a plurality of Christmas lamps 13 each of which has a base, a bulb 14 in the top and a pair of lead-in wires 141 and 142 respectively attached to the lateral sides of the base, a pair of first semi-circular grooves 112 and 113 spacedly formed in the opened bottom 111 adjacent front end thereof for respectively disposing a pair of electric wires 18 and 19, a plurality of inverse U-shaped copper plates 15 respectively pressed into the gaps between each pair of the adjacent lamps 13 having their lateral portions engaged with the lead-in wires, wherein the foremost one has a first tip 151 on the lower end of a outer lateral portion pierced into the inner electric wire 19. The seat 11 further has a slender slot 114 in one of the side walls for disposing an elongate copper plate 16 which has a tip end 161 pierced into the outer electric wire 18 and engaged with a lead-in wire 141 of the foremost lamp 13 and a contact end 162 engaged with a lead-in wire 142 of the rearmost lamp 13 (as shown in FIG. 4), an elongate cover 17 pressedly covering the opened bottom 111 and having a pair of second semi-circular grooves 171 and 172 engaged with the first semi-circular grooves 112 and 113, a U-shaped projection 173 between the grooves 171 and 172 which is functioned to separate the tip end 161 of the elongate copper from the inverse U-shaped copper plate 15 and a plurality of rectangular projection 174 spacedly formed on the top along the length thereof for stopping against the inverse U-shaped copper plates 15. Upon the above arrangement, an electric circulation is therefore established inside the alignment of sockets 10 to light the Christmas lamps 13.

Figure 7:
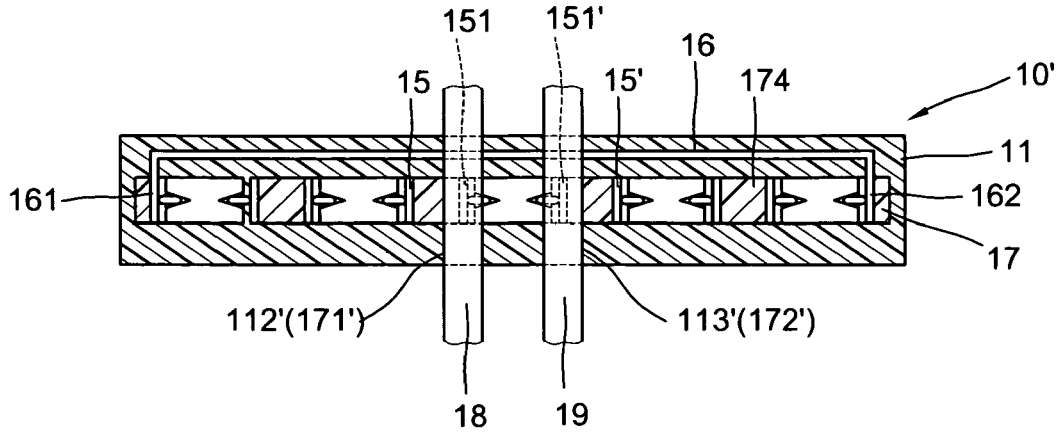
FIG. 7 is a top sectional view to show an alternate arrangement of the electric wires.

FIG. 7 shows an alternate arrangement 10' of the above embodiment 10. That's moved the pair of elective wires 18 and 19 from the front to the middle portion of the hollow interior seat 11. So that the pair of first semi-circular groove 112 and 113 and the second semi-circular grooves 171 and 172 are also moved to the middle portion and redesignated as 112' and 113', 171' and 172'. Simultaneously, the two U-shaped copper plates 15 in the middle portion each adds a tip respectively pierced into the electric wires 18 and 19 and the two U-shaped copper plate are also redesignated as 15'. This movement of the electric wires 18 and 19 aims to improve the balance for the first embodiment but don't affect the circulation of the electricity inside the alignment of sockets.

Figure 8:
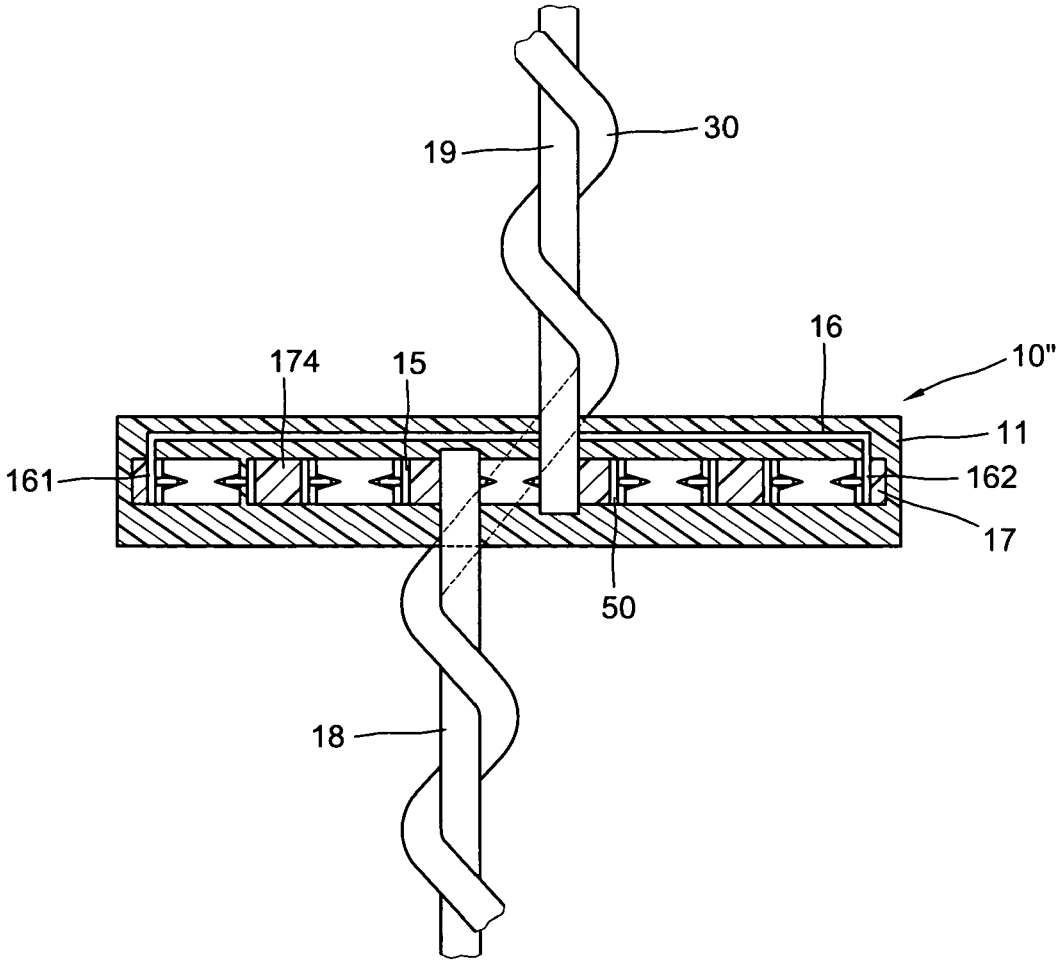
FIG. 8 is a top sectional view to show another alternate arrangement of the electric wires.

FIG. 8 shows another alternate arrangement 10" of the above embodiment 10 in which the electric wires 18 and 19 respectively and alternately inserted their ends into the middle portion of the hollow interior seat 11. An additional electric wire 30 connects to the electric wire 18 and 19 and bandages on them for supplying the power source to keep the electric circulation inside the seat 11.

In fact, the electric wires 18 and 19 in the above embodiment can be nude a portion directly contacted the copper plate. Thus the tips can be omitted.

Figure 9:
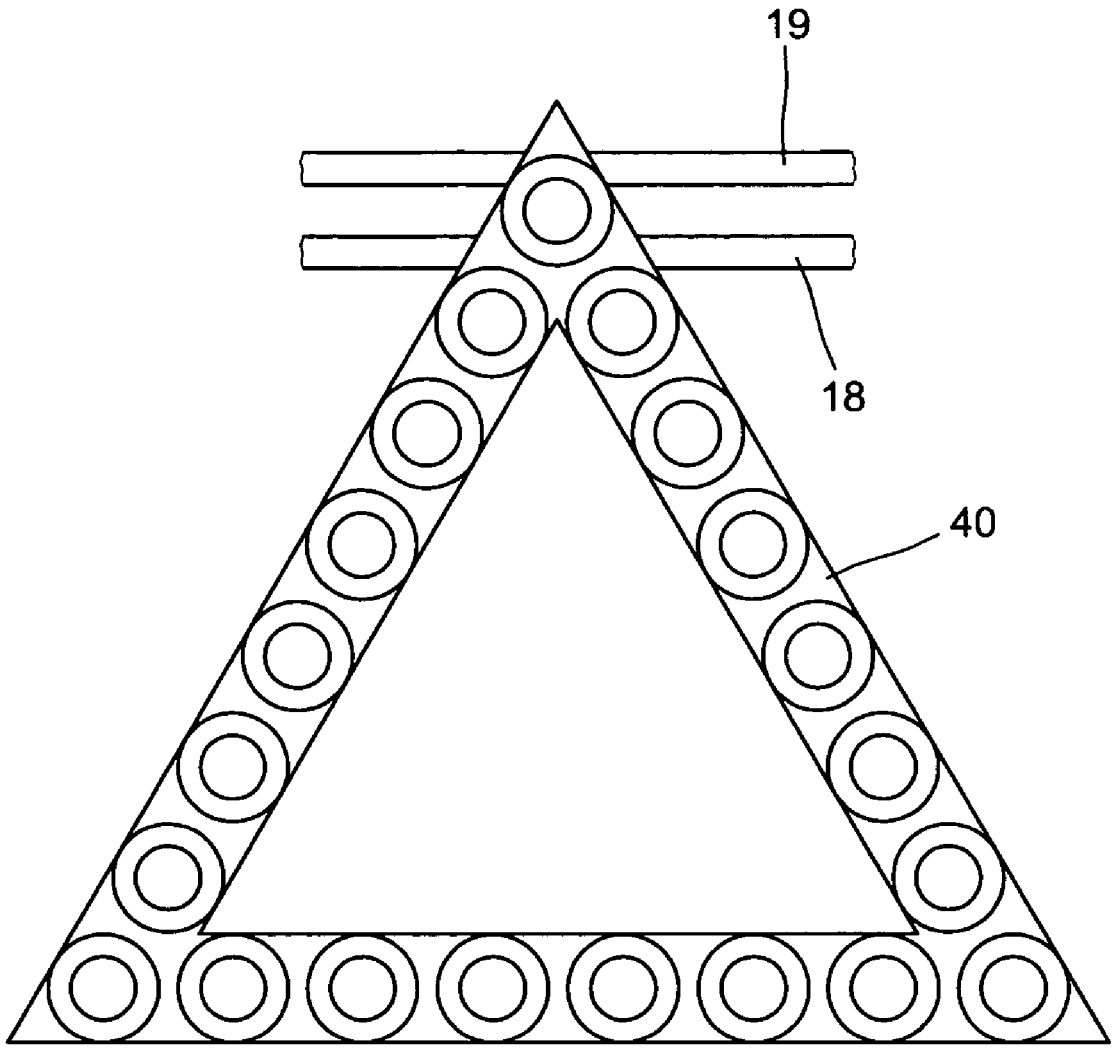
FIG. 9 is a plane view indicating that the alignment of socket is capable of making a triangular shape.

FIG. 9 shows that the above embodiment 10 is capable of making a triangular shape 40 without changing the internal structure. In order to facilitate the suspending of the triangular shape 40 from an object, the pair of the electric wires 18 and 19 are moved to a peak of the triangular 40.

Figure 10:
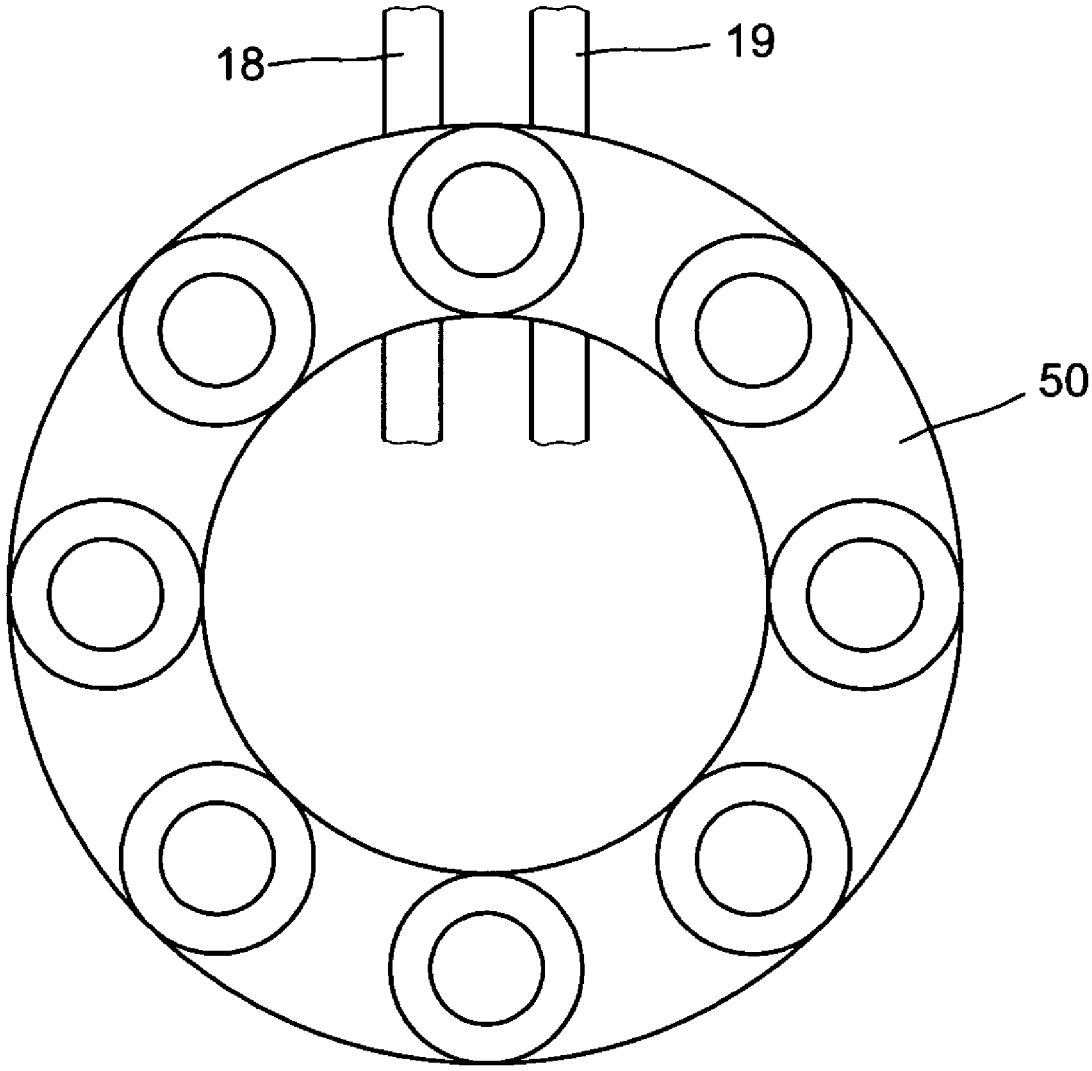
FIG. 10 is a plane view indicating that the alignment of sockets is capable of making a circular shape.

FIG. 10 shows a circular shape 50 made of the above embodiment 10. Meanwhile, the electric wires 18 and 19 are positioned at the upper portion to enable the circular shape 50 to suspend from a proper object.

Figure 11:
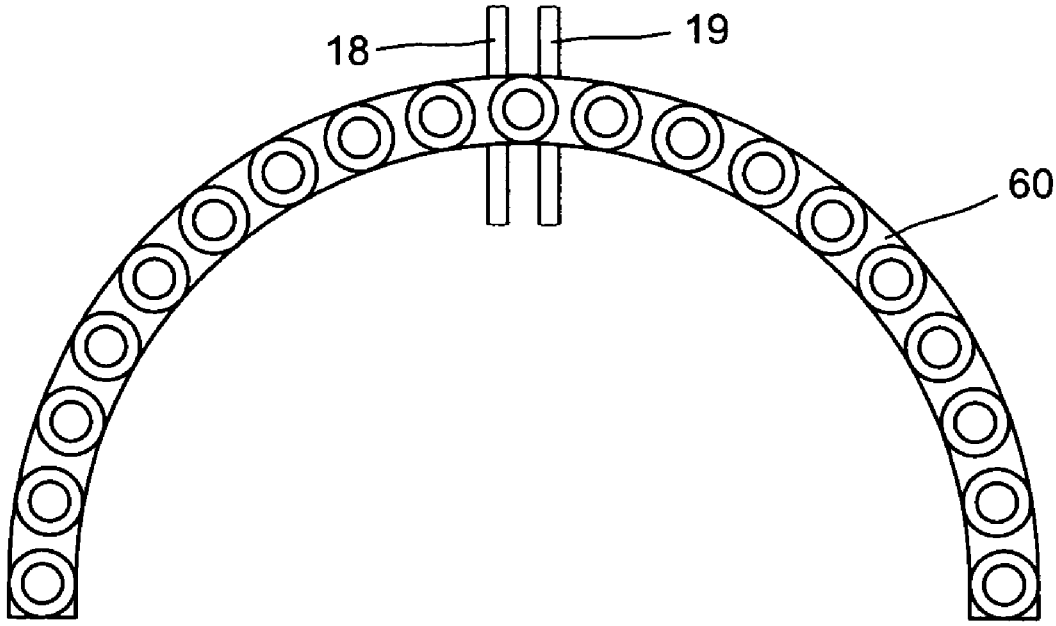
FIG. 11 is a plane view indicating that the alignment of sockets is capable of making a semi-circular shape.

FIG. 11 shows a semi-circular shape of Christmas light 60 made of the above embodiment 10 and the electric wires 18 and 19 are simultaneously moved to the central top thereof.

Figure 12:
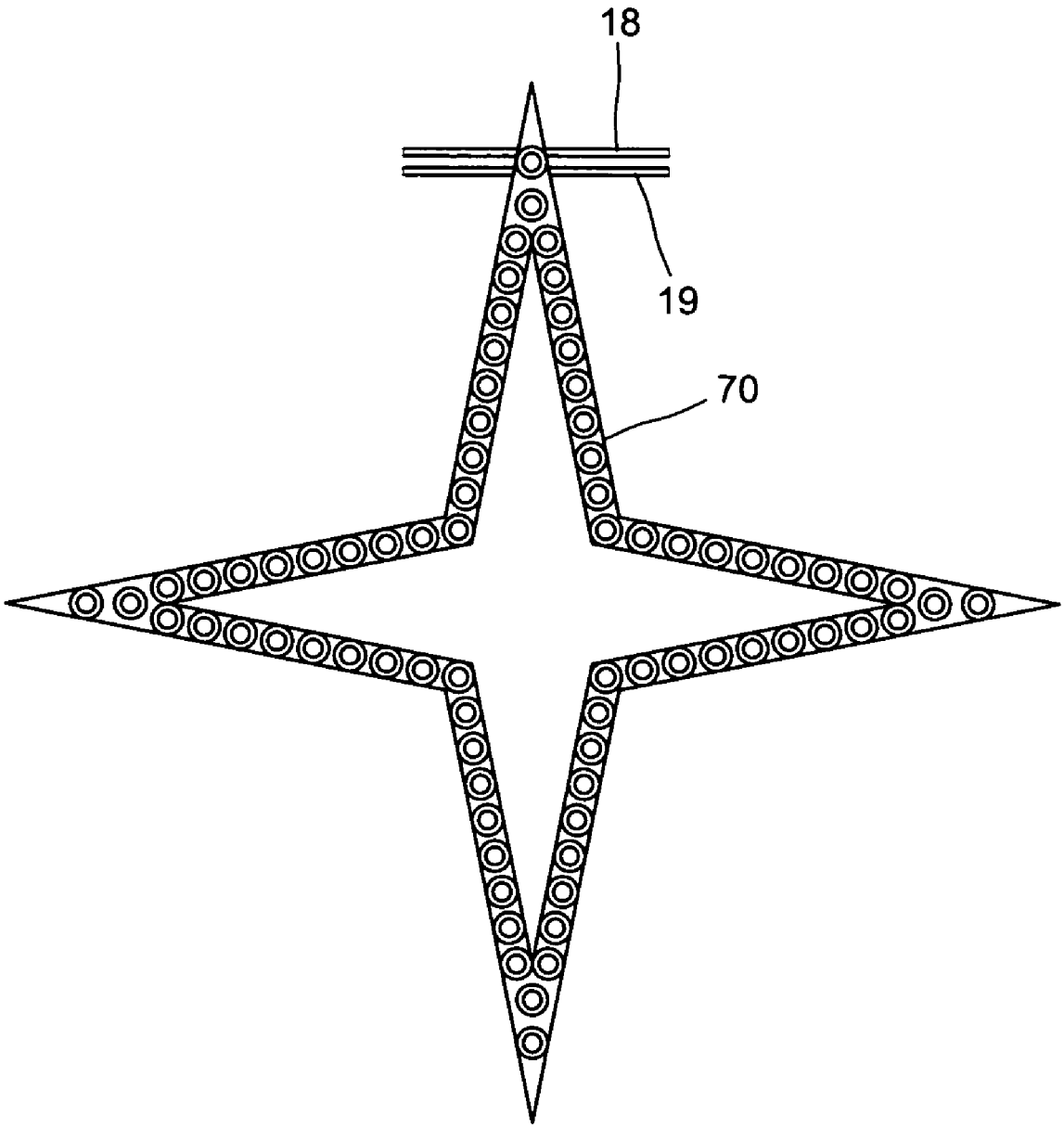
FIG. 12 is a plane view indicating that the alignment of sockets is capable of making a star shape.

FIG. 12 shows a star shaped Christmas lights 70 made of the above embodiment 10 and the electric wires 18 and 19 are also moved to the top of the star 70.

The above shapes of Christmas light may suspend by any linear means.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. An alignment of sockets enabling to engage with a large number of Christmas lamps comprising:

a hollow interior rectangular seat having a plurality of protruding circular openings arranged on top and communicating to the hollow interior, lateral walls extending downward forming an opened bottom, a pair of first semi-circular grooves spacedly formed in the bottom and a slender slot in one of lateral walls along the length thereof;

an elongate copper plate disposed into the slender slot of said seat along the length thereof, having a tip end and a contact end engaged a lead-in wire of a rearmost lamp;

a plurality of lamps, respective engaged within said protruding circular openings, each lamp having a base, a bulb in top and a pair of lead-in wires respectively attached to lateral sides of said base;

a plurality of inverse U-shaped copper plates pressed into gaps between each pair of adjacent lamps having their lateral portions engaged with one of the lead-in wires, wherein a foremost inverse U-shaped plate has a tip on a lower end of an outer lateral portion;

an elongate cover covering the opened bottom of said hollow interior seat in a snap fitting manner having a pair of second semi-circular grooves engaged with said first semi-circular grooves respectively, a U-shaped projection positioned between the pair of second semi-circular grooves and a plurality of rectangular projections spacedly positioned along the length thereof and respectively inserted into said inverse U-shaped copper plates;

a pair of electric wires disposed in said first semi-circular grooves pierced by the tip end of said elongate copper plate and the tip of the foremost inverse U-shaped copper plate respectively;

whereby, an electric circuit is established within the alignment of sockets to light up said Christmas lamps.

2. The alignment of sockets as recited in claim 1, wherein said pair of electric wires may move to a middle portion of said hollow interior seat.

3. The alignment of sockets as recited in claim 1, wherein said pair of electric wires may connect to an additional electric wire which bands on said pair of electric wires.

4. The alignment of sockets as recited in claim 1, wherein said alignment of sockets may make varied shapes such as a triangular, a circle, a semi-circle and a star.

* * * * *